US005284167A

United States Patent [19]

Gill

[11] Patent Number: 5,284,167

[45] Date of Patent: Feb. 8, 1994

[54] METHOD AND APPARATUS FOR HAIR DRESSING

[75] Inventor: Gayle R. Gill, 1921 St. Michael's Rd., Lincoln, Nebr. 68512

[73] Assignees: Gayle R. Gill; Turner H. Gill, JR., both of Lincoln, Nebr.

[21] Appl. No.: 98,791

[22] Filed: Jul. 29, 1993

[51] Int. Cl.[5] ..... A45D 24/00

[52] U.S. Cl. ..... 132/200; 132/144; 132/145; 132/278; 132/279; 132/129

[58] Field of Search ..... 132/106, 126, 129, 131, 132/132, 133, 134, 135, 140, 144, 145, 148, 273, 275, 278, 279

[56] References Cited

U.S. PATENT DOCUMENTS

| | | | |
|---|---|---|---|
| 673,098 | 4/1901 | Tissier | 132/279 |
| 694,934 | 3/1902 | Machado | 132/279 |
| 849,766 | 4/1907 | Baker | 132/279 |
| 941,586 | 11/1909 | Purdy | 132/133 |
| 1,052,310 | 2/1913 | Burlando | 132/279 |
| 1,609,208 | 12/1926 | Schneeberger | 132/279 |
| 1,721,837 | 7/1929 | Schurger | 132/133 |
| 2,509,658 | 5/1950 | Wallace | 132/145 |
| 2,613,679 | 10/1952 | Vaughn | 132/144 |
| 3,998,233 | 12/1976 | Dorr | 132/279 |

*Primary Examiner*—Gene Mancene

*Assistant Examiner*—Frank A. LaViola

*Attorney, Agent, or Firm*—Zarley, McKee, Thomte, Voorhees & Sease

[57] ABSTRACT

A hairdressing apparatus includes a clamp having a pair of ribs which are pivotally connected at a lower end and adjustably releasably connected at an upper end, to grip hair therebetween. A comb portion includes a back with teeth projecting therefrom, and upper and lower legs projecting from the ends of the back parallel to the teeth. The projecting ends of the comb legs are releasably connected to the upper and lower ends of the clamp portion to secure the comb portion and clamp portion together. A method for styling hair utilizing the hairdressing apparatus includes the initial step of brushing the hair rearwardly to form a ponytail having long and short hair strands. The clamp portion of the hairdressing apparatus is then clamped on the ponytail at a location to grip both the long and short hair strands, and spaced away from the head. The end of the ponytail is then rolled towards the head, the roll being parallel to the clamp apparatus, until the clamp apparatus is wrapped into the roll. The comb portion of the hair styling apparatus is then inserted with the teeth located between the roll and the wearer's head, and the projecting legs are connected to the ends of the clamp portion to secure the clamp portion into the hair with the comb.

8 Claims, 4 Drawing Sheets

METHOD AND APPARATUS FOR HAIR DRESSING

TECHNICAL FIELD

The present invention relates generally to combs utilized in dressing and arranging the hair, and more particularly to a combination comb and clasp utilized to dress the hair in a French roll.

BACKGROUND OF THE INVENTION

Various ornamental combs, barrettes and other devices have long been used to dress and style the hair. A comb is a well known apparatus having a plurality of generally parallel teeth which will direct the hair in a single direction when passed therethrough. The comb may also be utilized as a fastening device to hold the hair in a desired position, by inserting the teeth of the comb through the hair.

A barrette is typically utilized to clamp the hair into a confined position, and conventionally includes two opposed rib-like members hinged for movement therebetween. One or both of the ribs typically includes teeth to better retain the hair between the members. The two ribs are selectively connected together at the free ends, opposite the hinge, to fasten the hair into position.

Combs, barrettes and other hair dressing devices have been utilized with many hair styles throughout history. One particular type of hair style, commonly known as the "French roll", has remained popular for many years. However, this hair style has been limited to persons having hair of a single length. In addition, the style is typically time consuming to create, even for those persons having the appropriate single length hair.

SUMMARY OF THE INVENTION

It is therefore a general object of the present invention to provide an apparatus and method for simply and easily dressing the hair in a French roll.

Still another object of the present invention is to provide an apparatus for creating a French roll in variable length hair.

Still a further object is to provide an apparatus for dressing the hair in a French roll which enables the hair to be dressed quickly and easily, yet appears identical to conventional French roll styles.

These and other objects will be apparent to those skilled in the art.

The hairdressing apparatus of the present invention includes a clamp having a pair of ribs which are pivotally connected at a lower end and adjustably releasably connected at an upper end, to grip hair therebetween. A comb portion includes a back with teeth projecting therefrom, and upper and lower legs projecting from the ends of the back parallel to the teeth. The projecting ends of the comb legs are releasably connected to the upper and lower ends of the clamp portion to secure the comb portion and clamp portion together.

The method for styling hair utilizing the hairdressing apparatus of the present invention, includes the initial step of brushing the hair rearwardly to form a ponytail having long and short hair strands. The clamp portion of the hairdressing apparatus is then clamped on the ponytail at a location to grip both the long and short hair strands, and spaced away from the head. The end of the ponytail is then rolled towards the head, the roll being parallel to the clamp apparatus. The hair stylist continues to roll the formed hair roll towards the wearer's head until the clamp apparatus is wrapped into the roll. The comb portion of the hair styling apparatus is then inserted with the teeth located between the roll and the wearer's head, and the projecting legs are connected to the ends of the clamp portion to secure the clamp portion into the hair with the comb.

DESCRIPTION OF THE PREFERRED EMBODIMENTS

Figure 1:
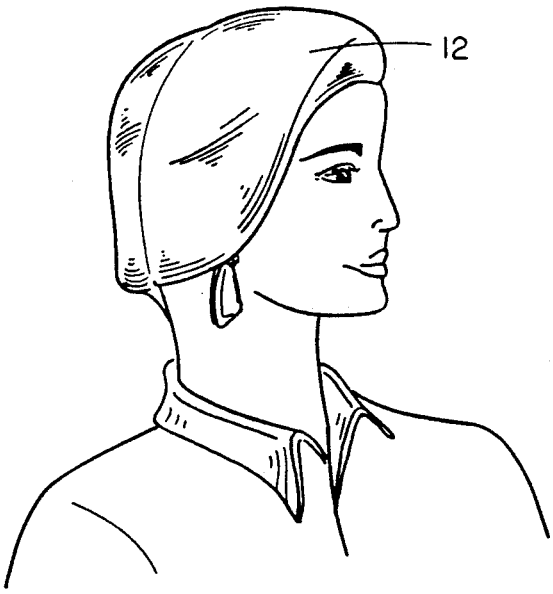
FIG. 1 is a forward perspective view of a person wearing a French roll created using the apparatus and method of the present invention.
Figure 2:
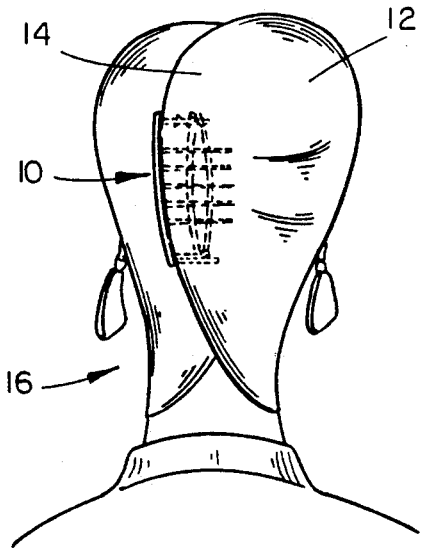
FIG. 2 is a rear elevational view of the hair style shown in FIG. 1.

Referring now to the drawings, in which similar or corresponding parts are identified with the same reference numeral and more particularly to FIG. 1, the method of the present invention was utilized to dress the hair 12 into the style commonly referred to as a French roll. As shown in FIG. 2, this hair style includes a generally vertically oriented roll 14 formed of a swatch of hair 12, positioned along the back of the wearer's head 16 and held in place by the hair dressing apparatus, designated generally at 10, of the present invention.

Figure 3:
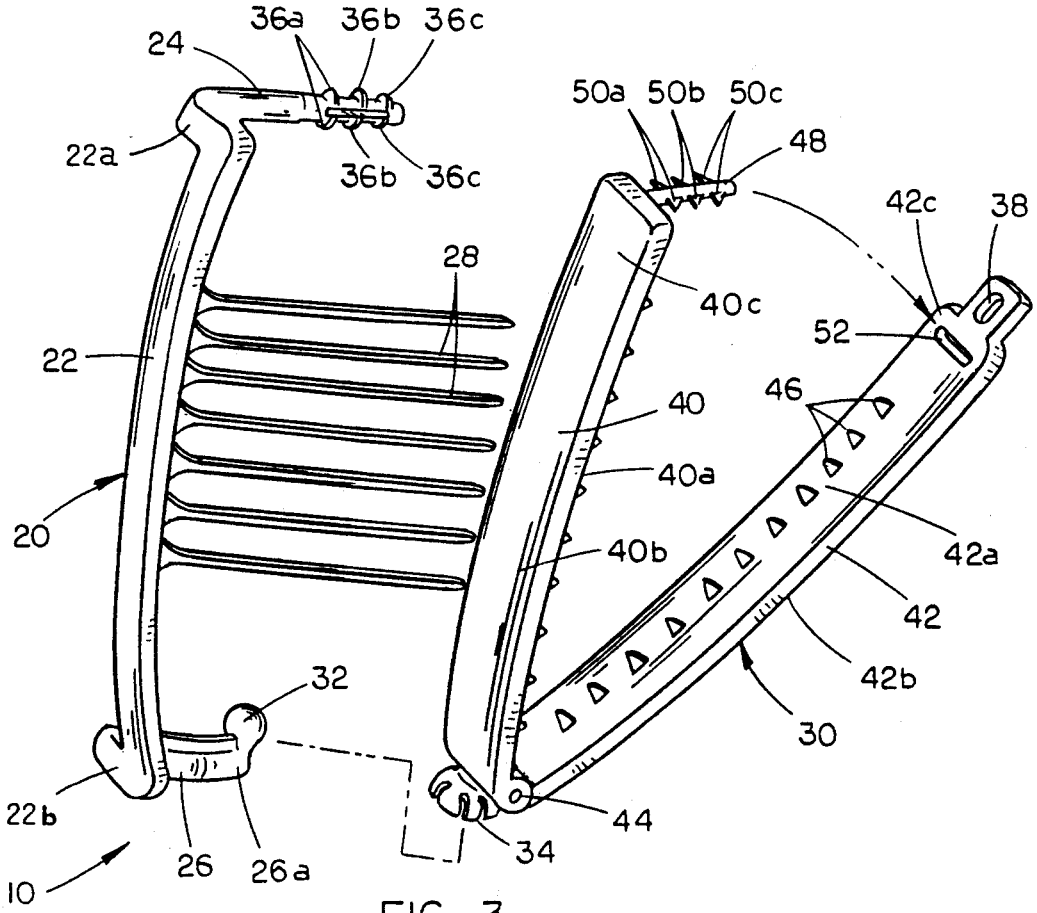
FIG. 3 is an exploded perspective view of a first embodiment of the hair dressing apparatus of the present invention.

Referring now to FIG. 3, a first embodiment of the hair dressing apparatus 10 is shown in more detail. In general, hair dressing apparatus 10 includes a comb portion 20 operably connected to a clamp portion 30. The clamp 30 is designed to grip a swatch of hair and rotate the swatch to form the roll. Comb 20 is then secured to clamp 30, against the wearer's head, to maintain the roll in the desired position.

Comb 20 includes a generally rigid, elongated back 22 with a generally perpendicularly projecting upper leg 24 and lower leg 26, extending from opposite ends thereof. A plurality of spaced apart teeth 28 project from back 22, and are generally parallel to upper and lower legs 24 and 26. As shown in FIG. 3, legs 24 and 26 are transversely offset from back 22 by extensions **22*a* and 22*b*, respectively, but are still parallel to teeth 28**, for a purpose described in more detail hereinbelow.

The forwardly projecting end **26*a* of lower leg 26 includes a ball 32 formed thereon designed for rotatable engagement within a socket 34 on clamp 30, described hereinbelow. Upper leg 24 36***b* and 36*c*, spaced uniformly along the length of leg 24. Lug pairs 36*a*, 36*b* and 36*c* are designed for selective engagement with a corresponding slot 38 formed in clamp 30, also described hereinbelow.

As discussed above, clamp 30 is operable to grip a swatch of hair, and includes a pair of elongated opposingly disposed ribs 40 and 42 connected at a lower end by a hinge 44, for pivotal movement towards and away from one another.

Ribs 40 and 42 include an inward face 40*a* and 42*a* respectively, and an outward face 40*b* and 42*b* respectively. A plurality of teeth 46 are preferably mounted on inward faces 40*a* and 42*a*, arranged in oppositely projecting relation and intermeshed to hold hair between ribs 40 and 42.

A rigid arm 48 projects generally perpendicularly inwardly from the free end 40*c* of rib 40. Sets of diametrically opposed lugs 50*a*, 50*b* and 50*c* are formed on arm 48 and are designed to engage a slot 52 formed in the free end 42*c* of rib 42. Thus, the ribs 40 and 42 of clamp 30 may be selectively locked together to grip a swatch of hair therebetween. Lug sets 50*a*, 50*b* and 50*c* permit adjustment of the clamping force provided by clamp 30.

Ball socket 34 is mounted on hinge portion 44 of clamp 30, to receive ball 32 therein. Socket 34 and slot 38 are generally centered along clamp 30. Legs 24 and 26 are transversely offset from back 22 such that teeth 28 will be positioned adjacent clamp 30 when ball 32 and lugs 36 are connected to socket 34 and slot 38 respectively.

Figure 4:
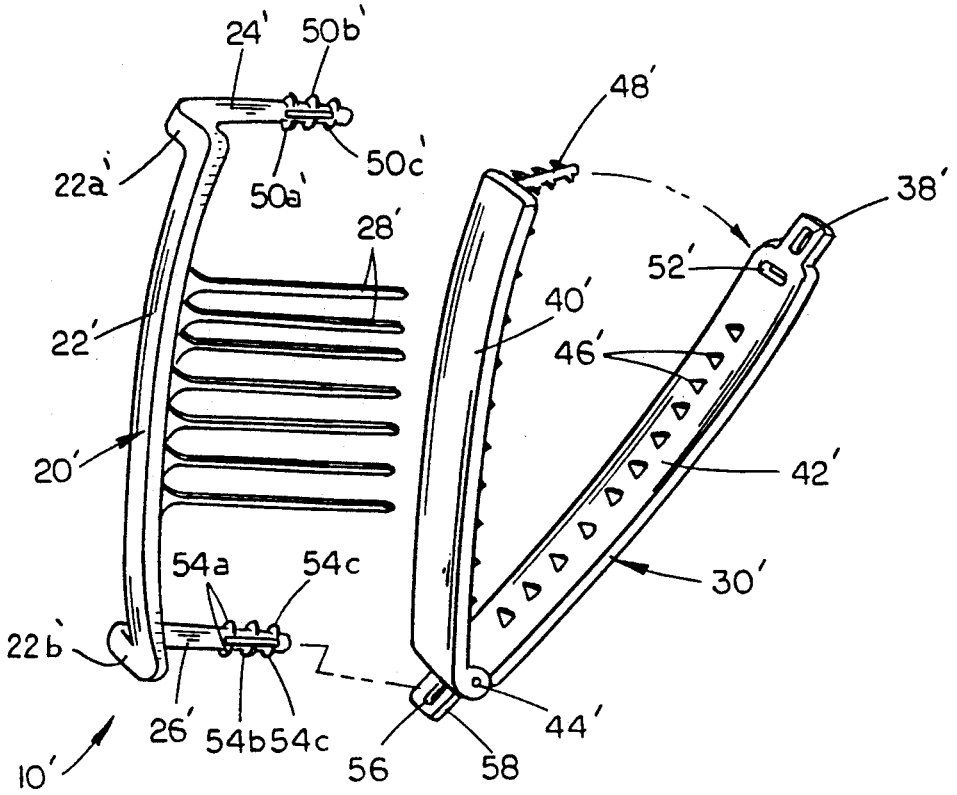
FIG. 4 is an exploded perspective view of a second embodiment of the present invention.
Figure 5:
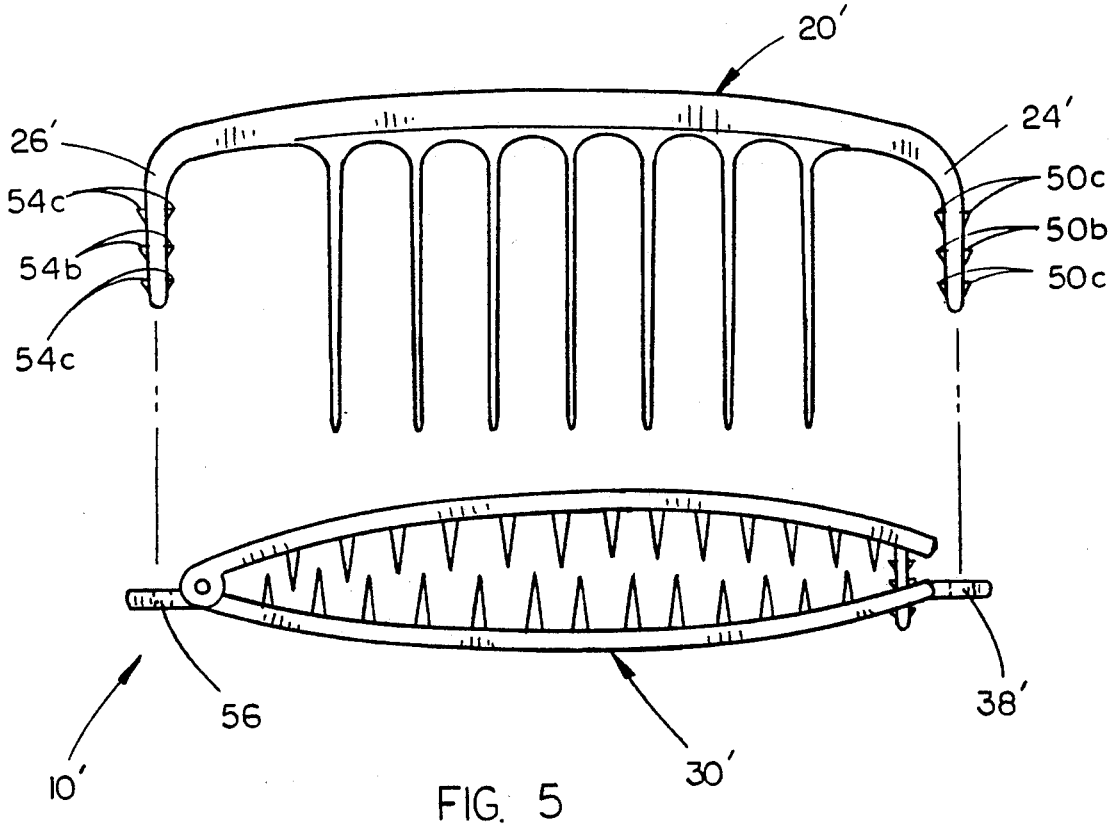
FIG. 5 is a side elevational view of the second embodiment of the invention shown in FIG. 4.

Referring now to FIGS. 4 and 5, a second embodiment of the hair dressing apparatus is designated generally at 10' and includes a comb portion 20' and clamp portion 30'. Comb 20' includes the same upper and lower legs 24' and 26' projecting from transverse extensions 22*a'* and 22*b'* of elongated back 22', with teeth 28' parallel to legs 24' and 26'. Similarly, clamp 30' includes a pair of ribs 40' and 42' connected at a lower end by a hinge 44', with inwardly directed opposing and intermeshable teeth 46'. The main difference between the first embodiment shown in FIG. 3 and the second embodiment shown in FIG. 4 is in the interconnection of comb 20' to clamp 30'.

In the second embodiment of hair dressing apparatus 10', lower leg 26' includes sets of paired diametric lugs 54*a*, 54*b* and 54*c* designed for selective engagement with a corresponding slot 56 formed in a projecting flange 58 mounted on hinge 44' of clamp 30'.

Referring now to FIG. 5, comb 20' is removably connected to clamp 30' by the insertion of legs 24' and 26' into the corresponding slots 38' and 56, respectively, in clamp 30'. The various sets of lugs on legs 24' and 26' permit selective adjustment of the comb 20' with clamp 30' to increase or decrease the gripping force applied to the hair.

Figure 6:
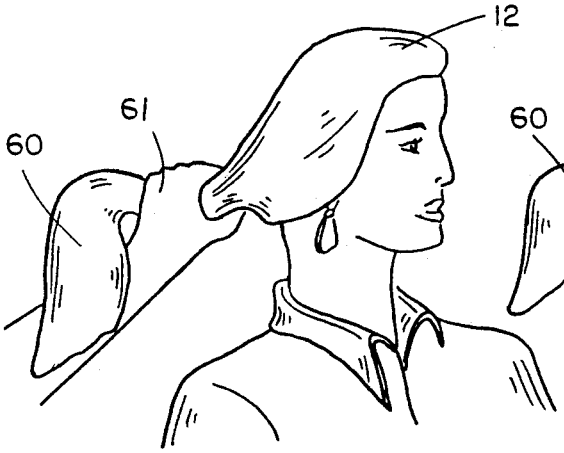
FIG. 6 is a side perspective view showing the first step in creating the French roll utilizing the method of the present invention.
Figure 7:
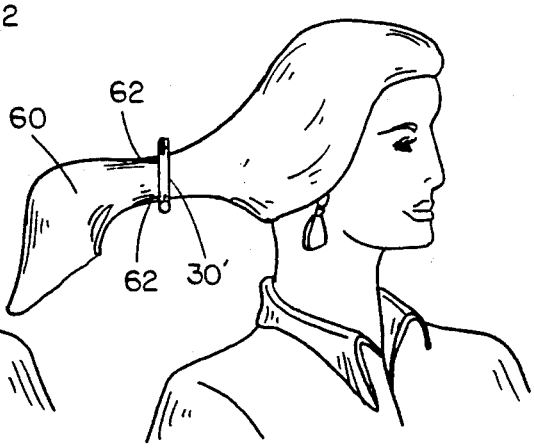
FIG. 7 is a view similar to FIG. 6 showing a second step of the method of this invention.

Referring now to FIGS. 6–10, the method for styling hair into a French roll includes the initial step of brushing the hair 12 rearwardly so as to form a ponytail configuration 60. FIG. 6 shows the ponytail being gripped by one hand 61 while the clamp 30' is fastened to the hair at a location to grip the ponytail 60 and the shortest lengths of hair, indicated generally at 62 in FIG. 7. As shown in FIG. 4, clamp 30' is fastened to the hair by inserting arm 48' into slot 52' and pivoting ribs 40' and 42' about hinge 44'.

Figure 8:
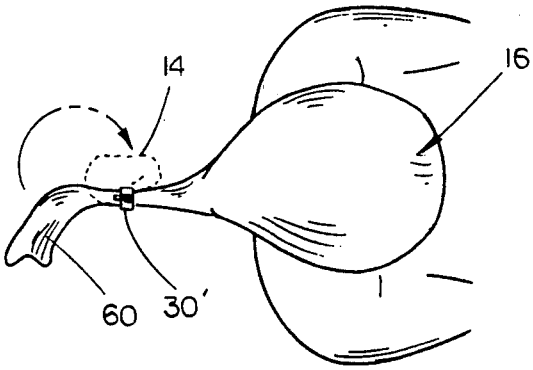
FIG. 8 is a top downward looking view showing a third step of the present invention.
Figure 9:
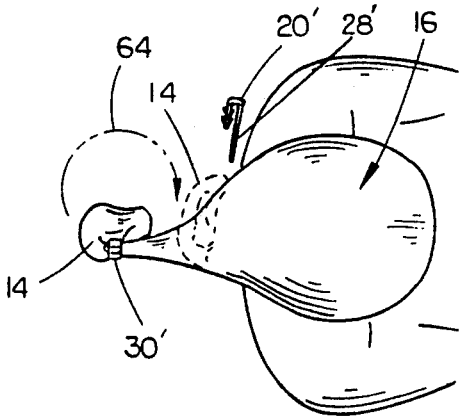
FIG. 9 is a view similar to FIG. 8, showing a fourth step of the method of the invention.
Figure 10:
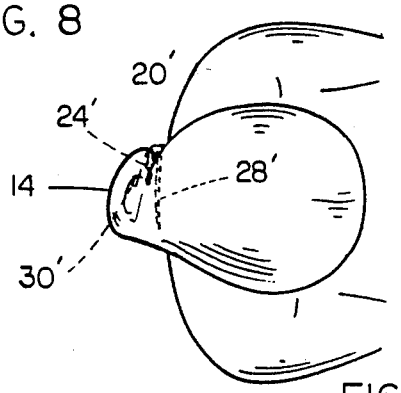
FIG. 10 is a view similar to FIG. 9 showing a fifth step of the method of the present invention.

The end of ponytail 60 is then rolled forwardly towards the head 16, as shown in FIG. 8, to form a vertically oriented roll 14, shown in broken lines in FIG. 8. Roll 14 is rolled forwardly, as shown by arrow 64 in FIG. 9, towards the head 16 until clamp 30' is wrapped into roll 14, as shown in broken lines in FIG. 9. Comb 20' is then inserted with teeth 28' behind hair roll 14 and against the wearer's head 16. Comb 20' is then connected to clamp 30', so as to secure hair roll 14 in position, as shown in FIGS. 9 and 10, by inserting legs 24' and 26' through slots 38' and 56, as shown in FIG. 5.

Although the method of this invention was described with respect to hair dressing apparatus 10', the same method is utilized in applying the hair dressing apparatus 10 of FIG. 3. The only difference relates to the position of comb 22 during the process of clamping and rolling the hair, wherein comb 22 would dangle from socket 34 on clamp portion 30. Once the hair had been rolled to the position shown in FIG. 9, comb 22 would be pivoted upwardly on socket 34 so as to secure leg 24 in slot 38 to hold the hair roll in position.

Figure 11:
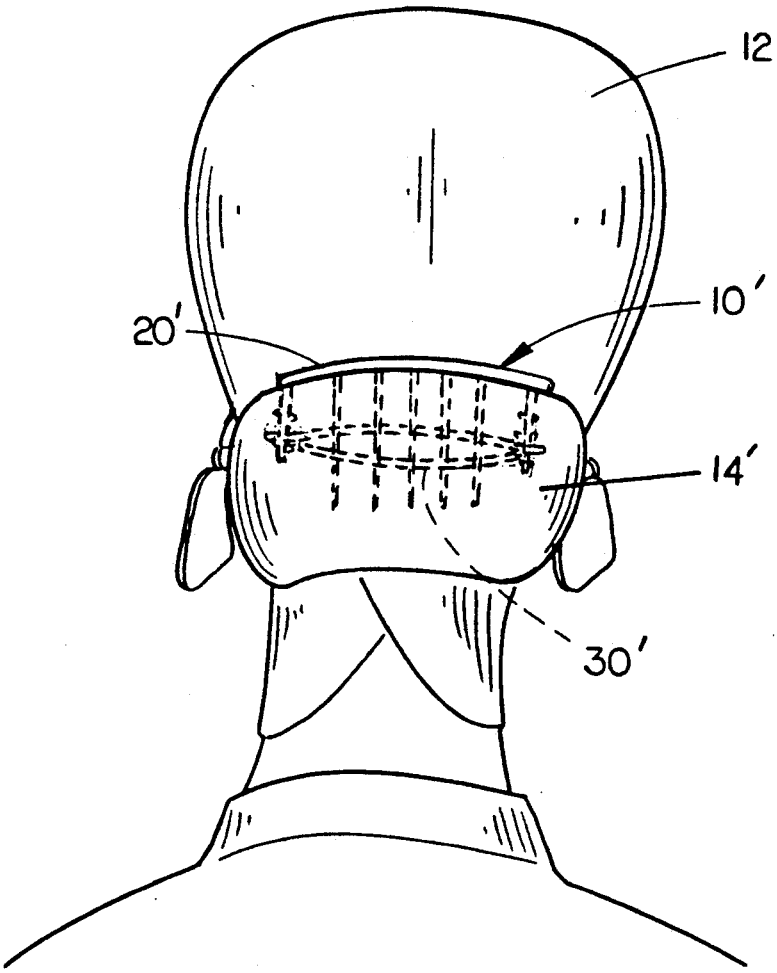
FIG. 11 is a rear elevational view of a different orientation of the hair style created using the present invention.

Similarly, the method and apparatus of this invention may be utilized to style hair with the roll 14' oriented in other directions, as shown in FIG. 11. A horizontally oriented roll 14' is created using the same method described relative to a vertically oriented french roll.

Whereas the invention has been shown and described in connection with the preferred embodiments thereof, it will be understood that many modifications, substitutions and additions may be made which are within the intended broad scope of the appended claims. There has therefore been shown and described an improved method and apparatus for styling hair into a French roll which accomplishes at least all of the above stated objects.

I claim:

1. A hairdressing apparatus, comprising:

a clamp portion having a forward and a rearward elongated rib pivotally connected at a lower end for pivotal movement towards and away from each other;

means on upper ends of said ribs for releasably joining the ribs;

a comb portion removably operably connected to said clamp portion;

said comb portion including an elongated back with a plurality of teeth projecting therefrom and upper and lower legs projecting from opposite ends of the back parallel to the teeth;

said upper leg having a projecting end with first means for operably connecting the leg to the upper end of said clamp portion;

said lower leg having a projecting end with second means for operably connecting the leg to the lower end of said clamp portion;

said comb portion teeth being located adjacent the side of said clamp portion when both comb legs are connected to said clamp portion.

2. The hairdressing apparatus of claim 1, wherein said comb portion back is generally straight, and further comprising upper and lower extension member projecting transversely from the ends of said back, perpendicular to the plane of the teeth, said upper and lower legs projecting from said extensions so as to be transversely spaced from the comb back and parallel to the comb teeth.

3. The hairdressing apparatus of claim wherein said first leg connecting means includes means for adjustably connecting said upper leg to the upper end of said clamp portion.

4. The hairdressing apparatus of claim 3, wherein said first leg connecting means includes a plurality of spaced apart lugs formed along said upper leg, and a slot formed in the upper end of one of said clamp ribs for releasably receiving said upper leg and lugs therethrough.

5. The hairdressing apparatus of claim 2, wherein said second leg connecting means includes means for releasably, adjustably connecting said lower leg to the lower end of said clamp portion.

6. The hairdressing apparatus of claim 5, wherein said second leg connecting means includes a plurality of spaced apart lugs formed along said lower leg, and a slot formed in the lower end of one of said clamp ribs for releasably receiving said lower leg and lugs therethrough.

7. The hairdressing apparatus of claim 2, wherein said second leg connecting means includes a ball formed on a projecting end of said lower leg, and a socket mounted on the lower end of one of said clamp ribs for receiving said ball rotatably therein.

8. A method for styling hair, comprising the steps of:

brushing the hair rearwardly on the head to form a ponytail having long hair strands and short hair strands;

gripping the ponytail with an elongated clamp apparatus of the type having a pair of elongated ribs with opposing ends connected together to grip hair therebetween, said clamp apparatus attached at a location on the ponytail to grip both the long and short strands;

folding the free end of the ponytail upon itself to form a roll having a longitudinal axis generally parallel to the longitudinal axis of the clamp apparatus;

continuing to roll the formed roll towards the wearer's head until the clamp apparatus is wrapped into the roll;

providing a comb having a back portion with projecting teeth and opposing end legs parallel to the teeth, said comb having means on the legs for releasably connecting the legs to the ends of said clamp apparatus;

inserting the comb into the hair with the back portion parallel to the clamp apparatus, with the comb teeth located between the formed roll and the wearer's head; and connecting said comb legs to said clamp apparatus ends to secure the clamp apparatus and formed roll in position.

* * * * *